106-80 AU 115 EX
1/24/78 XR 4,070,196

United States Patent [19]
Kraak et al.
[11] 4,070,196
[45] Jan. 24, 1978

[54] BINDER COMPOSITIONS

[75] Inventors: Andries Kraak, Veendam, Netherlands; Raymond Douglas George, Birmingham, England

[73] Assignees: Foseco International Limited, Birmingham, England; Co-operative Verkoap-en Productievereiniging van Aardappelmeel en Derivaten "Avebe" G.A., Veendam, Netherlands

[21] Appl. No.: 719,151

[22] Filed: Aug. 31, 1976

[30] Foreign Application Priority Data

Sept. 15, 1975 United Kingdom ..... 37884/75
Aug. 13, 1976 United Kingdom ..... 33873/76

[51] Int. Cl.[2] ..... B28B 7/34

[52] U.S. Cl. ..... 106/38.35; 106/38.5 R; 106/80; 106/84; 106/208; 106/209; 106/213; 106/214; 164/16

[58] Field of Search ..... 106/38.23, 38.5 R, 80, 106/38.35, 208, 209, 213, 214, 84; 164/16

[56] References Cited

U.S. PATENT DOCUMENTS

| | | | |
|---|---|---|---|
| 2,024,123 | 12/1935 | Baker | 106/80 |
| 2,905,563 | 9/1959 | Ilenda et al. | 106/38.3 |
| 3,433,691 | 3/1969 | Reese | 106/80 |
| 3,642,503 | 2/1972 | Beaney | 106/38.35 |

*Primary Examiner*—Lorenzo B. Hayes
*Attorney, Agent, or Firm*—Cushman, Darby & Cushman

[57] ABSTRACT

The breakdown properties of silicate bonded foundry sand moulds and cores can be improved by including with the silicate binder a starch hydrolysate having a dextrose equivalent of less than 5.

12 Claims, No Drawings

BINDER COMPOSITIONS

This invention relates to alkali metal silicate binder compositions for the production of foundry moulds and cores.

It is common practice to use aqueous alkali metal silicate solutions, particularly sodium silicate solutions as binders for sand for the production of foundry moulds and cores. The solutions usually contain 40–50% by weight of a sodium silicate having $SiO_2$:$Na_2O$ ratio of from 2.0:1 to 3.0:1. In one process the sodium silicate solution is mixed with sand, and the resultant mixture is formed into a mould or core. Carbon dioxide gas is then blown through the mould or core, and due to chemical reaction between the sodium silicate and the carbon dioxide a bonded mould or core results. In another process a so-called hardener, which may be for example, a mixture of diacetin and triacetin, is mixed with sodium silicate and sand, and the mixture is formed into a mould or core, which on standing hardens due to chemical reaction between the hardener and the sodium silicate.

A disadvantage of both processes is that after casting the moulds and cores are difficult to break down and remove from the solidified cast metal. This can be particularly disadvantageous in the case of cores of complex shape, and when the moulds and cores are used for the production of castings in metals which are cast at high temperatures, e.g. steel castings. Accordingly, numerous proposals have been made in the past to add materials, so-called breakdown agents, to the mixture of sand and sodium silicate, which will aid the breakdown or disintegration ability of the sand mould or core after casting.

Examples of breakdown agents which have been used include coal dust and carbohydrates such as cellulosic materials, e.g. woodflour, starches, starch derivatives e.g. starch hydrolysates and sugars, e.g. sucrose and dextrose.

When breakdown agents are used it is advantageous if they can be mixed with or dissolved in the sodium silicate solution since homogenisation of the sand-binder mixture can then be achieved more quickly and the core or mould manufacturing process can be simplified and automated more readily.

However if the breakdown agent is to be incorporated in the sodium silicate solution it is desirable that the solution remains stable on storage, preferably for three months or more. Unfortunately certain carbohydrate materials, which have been used as breakdown agents, e.g. reducing sugars such as glucose, react with the highly alkaline sodium silicate solution, and are converted into a black insoluble product. At the same time the solution increases in viscosity and will eventually become solid, due to consumption of sodium hydroxide and hence an increase in the silica to sodium oxide ratio of the sodium silicate.

Non-reducing sugars, such as sucrose, are efficient breakdown agents and form stable solutions when added to sodium silicate solutions. However they have attendant disadvantages since moulds and cores made from a sucrose-containing silicate-bonded sand are hygroscopic. Thus if moulds or cores are stored, particularly in a humid atmosphere they deteriorate in that their edges become friable, and they become weak.

It has now been found that a stable binder solution giving sand moulds or cores having good breakdown properties and which do not deteriorate on storage, can be produced by mixing together an alkali metal silicate solution and a stabilised starch hydrolysate having a dextrose equivalent of less than 5.

According to the present invention there is provided a binder composition comprising in aqueous solution an alkali metal silicate and a starch hydrolysate having a dextrose equivalent of below 5.

According further to the present invention there is provided a method of making an article of bonded particulate material, such as a foundry mould or core, which comprises forming to the desired shape a mixture comprising particulate material, an aqueous alkali metal silicate and a starch hydrolysate having a dextrose equivalent of below 5 and causing or allowing the mixture to harden.

The dextrose equivalent is defined as the reducing power i.e. the reducing sugar content of a starch hydrolysate expressed as D-glucose on a dry basis. In practice the lower the dextrose equivalent of the starch hydrolysate the longer will an alkali metal silicate solution containing the starch hydrolysate remain stable. Accordingly it is preferred that the starch hydrolysate has a dextrose equivalent of below 2, more preferably below 0.5.

Suitable starch hydrolysates may be prepared from starch hydrolysates of higher dextrose equivalent by selective oxidation, reaction with urea or urea derivatives or hydrogenation. The preferred method is by catalytic hydrogenation with hydrogen. The dextrose equivalent of the starch hydrolysate before hydrogenation is preferably between 5 and 75, more preferably between 10 and 40. After hydrogenation the dextrose equivalent of the starch hydrolysate is reduced below 5, preferably below 2 and more preferably below 0.5. The stabilised starch hydrolysates may be easily handled in the form of aqueous syrups, usually containing 40–70% by weight starch hydrolysate.

The preferred alkali metal silicate is sodium silicate. The $SiO_2$:$Na_2O$ ratio of the sodium silicate may vary widely, e.g. from 2:1 to 3.5:1 but sodium silicates having a ratio of from 2.0:1 to about 2.5:1 are preferred, since the higher ratio alkali metal silicates are more reactive chemically so binder compositions containing them tend to have a shorter shelf life.

The composition of the binder solution may also vary widely but it will usually be prepared by mixing together 1–50% by weight starch hydrolysate syrup and 50–99% by weight sodium silicate solution. Preferred compositions contain 10–30% by weight starch hydrolysate syrup and 70–90% by weight sodium silicate solution.

In use the binder composition will usually be mixed with sand at the rate of 2–10 parts by weight of binder composition per 100 parts by weight of sand.

The mixture may be hardened either by gassing with carbon dioxide, or by incorporating chemical hardening agents such as esters of polyhydric alcohols in known fashion.

The following examples will serve to illustrate the invention:

EXAMPLE 1

A binder composition was prepared having the following composition by weight:

Aqueous sodium silicate solution ($SiO_2$:$Na_2O$ 2.2:1, sodium silicate content 46.4% by weight)—80%

Hydrogenated starch hydrolysate syrup (Dextrose equivalent 0.005; starch hydrolysate content 65% by weight)—20%

3.5 parts by weight of the binder composition were mixed with 100 parts by weight silica sand (AFS Fineness No. 44). The sand-binder mixture was then used to prepare standard AFS 50mm high × 50mm diameter cylindrical cores. Cores were then gassed for various times with carbon dioxide gas at 25° C, 0.35 kg/cm² line pressure and 5.5 liters/minute flow rate.

The compression strengths of the cores produced were then measured:

a. on specimens immediately (i.e. within 10 seconds) after gassing, b. on specimens stored for 24 hours in a relatively dry laboratory atmosphere, c. on specimens stored for 24 hours under humid conditions (25°–27° C, relative humidity 90%).

The results obtained are tabulated below:

| | Compression Strength (Kg/cm²) | | |
|---|---|---|---|
| Gassing Time (seconds) | 10 | 30 | 120 |
| (a) | 2.4 | 4.9 | 12.1 |
| (b) | 26.9 | 22.3 | 14.9 |
| (c) | 14.1 | 11.5 | 9.8 |

For comparison purposes those tests were repeated with the hydrogenated starch hydrolysate syrup replaced by 20% by weight of an aqueous sucrose solution containing 65% by weight sucrose. The results obtained are tabulated below:

| | Compression Strength (Kg/cm²) | | |
|---|---|---|---|
| Gassing Time (seconds) | 10 | 30 | 120 |
| (a) | 2.3 | 5.6 | 11.2 |
| (b) | 17.7 | 8.6 | 5.4 |
| (c) | 8.3 | 8.7 | 8.2 |

These results show that a sand bonded with the binder composition containing the starch hydrolysate gives similar results to a sand containing sodium silicate solution and sucrose in terms of the strength of cores produced immediately after gassing. However it can be seen that the binder composition of the invention is markedly superior when cores are stored in either a relatively dry atmosphere or in a humid atmosphere.

In practice gassing times as high as 120 seconds would be considered excessive for a core as small as the standard AFS specimen, since overgassing and a lowering of compression strength could result. The effect of overgassing is normally most noticeable in cores stored in a dry or relatively dry atmosphere and a comparison of the results for the specimens gassed for 120 seconds in the above tables indicates that the starch hydrolysate-containing containing sand mix is less susceptible to overgassing than the sucrose-containing sand mix.

EXAMPLE 2

A binder composition was prepared having the following composition by weight:

Aqueous sodium silicate solution ($SiO_2$:$Na_2O$ 2.4:1; sodium silicate content 46.0% by weight)—70%

Hydrogenated starch hydrolysate syrup (Dextrose equivalent 0.003 : starch hydrolysate content 65% by weight)—30%

The composition was divided into three samples. One sample was tested immediately [a], one sample was tested after being stored for 2 months [b] and the remaining sample was tested after being stored for 3½ months [c].

Sand-binder mixtures and standard AFS cores were prepared using the procedures described in Example 1, and the compression strengths of the cores were measured immediately (within 10 seconds) after gassing. The following results were obtained.

| | Compression Strength (Kg/cm²) | | |
|---|---|---|---|
| Gassing Time (seconds) | 10 | 30 | 120 |
| (a) | 4.2 | 8.7 | 12.3 |
| (b) | 4.2 | 7.9 | 11.3 |
| (c) | 3.4 | 6.9 | 10.5 |

These results show that the binder composition of the invention deteriorates only very slightly on storage.

EXAMPLE 3

The unstored sample of the binder composition of Example 2 was used to assess the breakdown properties of sands bonded with the composition.

Sand cores were prepared and gassed as described in Example 1 and on a trial and error basis the gassing time required to produce a core compression strength of about 7 Kg/cm²was determined [about 25 seconds]. A number of cores were then gassed for this period of time, i.e. to a strength of about 7 Kg/cm². These cores were then stored for 24 hours in the laboratory, after which time they were heated for 5 minutes in a furnace at temperatures ranging from 200° to 1200° C and then cooled to room temperature. The compression strength of the cores was measured and the following results were obtained:

| Temperature | Compression Strength (Kg/cm²) |
|---|---|
| 200 | 61.2 |
| 400 | 12.3 |
| 600 | 2.5 |
| 800 | 0.6 |
| 1000 | 0 |
| 1200 | 0 |

These results show that the starch hydrolysate is an efficient breakdown agent.

EXAMPLE 4

100 parts (by weight) of an aqueous sodium silicate solution ($SiO_2$:$Na_2O$ ratio 2.4:1, 46% by weight solids) was mixed with 43 parts (by weight) of a hydrogenated starch hydrolysate syrup (65% by weight solids). This syrup had been obtained by catalytic hydrogenation of a starch hydrolysate having a DE of 30, and had a DE of 0.01.

3.5 parts of this premixed binder composition was mixed with 100 parts of sand (AFS fineness 50–55) used for making foundry moulds and cores. (AFS = American Foundrymans Society). This sand composition was rammed into a standard AFS 50mm × 50mm test core specimen and gassed with carbon dioxide (25° C; 0.35 Kg/cm² line pressure; 5.5 liter per minute flow rate) for 30 seconds giving an immediate compression strength of 9.9 Kg/cm².

Quickly after gassing an identically prepared specimen was exposed to humid conditions (25° C; 90% relative humidity) for 72 hours. After this treatment the compression strength was measured and was 10.6 $Kg/cm^2$ showing the excellent stability under these conditions.

The premixed binder composition appeared to be substantially stable over a period of 3 months in respect to its binding properties.

We claim:

1. A binder composition consisting essentially of an aqueous solution of an alkali metal silicate and a stabilized starch hydrolysate having a dextrose equivalent of below 5, the components being present in the weight ratios, calculated as solids, of 0.4 to 35 parts stabilized starch hydrolysate per 20 to 49.5 parts alkali metal silicate.

2. A binder composition according to claim 1 wherein the dextrose equivalent of the starch hydrolysate is below 2.

3. A binder composition according to claim 1 wherein the dextrose equivalent of the starch hydrolysate is below 0.5.

4. A binder composition according to claim 1 wherein the alkali metal silicate is a sodium silicate of $SiO:Na_2O$ ratio 2 to 3.5.

5. A binder composition according to claim 1 wherein the ratio of alkali metal silicate to starch hydrolysate is within the range corresponding to a mixture of 1 to 50% by weight of a starch hydrolysate syrup containing 40 to 70% by weight solids and 50 to 99% by weight of an aqueous alkali metal silicate solution containing 40 to 50% by weight solids.

6. A binder composition according to claim 1 wherein the ratio of alkali metal silicate to starch hydrolysate is within the range corresponding to a mixture of 10 to 30% by weight of a starch hydrolysate syrup containing 40 to 70% by weight solids and 70 to 90% by weight of an aqueous alkali metal silicate solution containing 40 to 50% by weight solids.

7. In the method of making an article of bonded particulate material which comprises forming to the desired shape a mixture comprising particulate material and a binder composition and causing or allowing the mixture to harden, the improvement comprising using as binder composition, a mixture, in aqueous solution, of an alkali metal silicate and a stabilized starch hydrolysate having a dextrose equivalent of below 5, the components being present in the weight ratios, calculated as solids, of 0.4 to 35 parts stabilized starch hydrolysate per 20 to 49.5 parts alkali metal silicate.

8. A method of making foundry moulds and cores according to claim 7 wherein the particulate material is sand.

9. A method according to claim 7 wherein 2 to 10 parts by weight of binder composition are used per 100 parts by weight of particulate material.

10. A method according to claim 7 wherein the mixture is caused to harden by gassing with carbon dioxide.

11. A method according to claim 7 wherein the mixture is caused to harden by incorporation therein of a chemical hardening agent.

12. A method according to claim 11 wherein the chemical hardening agent is at least one ester of a polyhydric alcohol.

* * * * *